US006044954A

United States Patent [19]

McLaughlin

[11] Patent Number: 6,044,954

[45] Date of Patent: Apr. 4, 2000

[54] METHOD AND APPARATUS FOR SELECTIVE OPERATION OF AN AIR COMPRESSOR AND VACUUM MACHINE

[75] Inventor: Daniel Patrick McLaughlin, Littleton, Colo.

[73] Assignee: Western Paytel, Inc., Wheatridge, Colo.

[21] Appl. No.: 09/100,602

[22] Filed: Jun. 19, 1998

[51] Int. Cl.[7] ..... G07F 17/06

[52] U.S. Cl. ..... 194/241; 194/904

[58] Field of Search ..... 194/241, 242, 194/904; 15/330, 300.1

[56] References Cited

U.S. PATENT DOCUMENTS

| | | | |
|---|---|---|---|
| D. 287,656 | 1/1987 | Waldrep et al. | D32/21 |
| 3,381,327 | 5/1968 | Kelley . | |
| 3,910,781 | 10/1975 | Bryant, Jr. | 55/305 |
| 4,036,346 | 7/1977 | Livingston | 194/9 |
| 4,194,262 | 3/1980 | Finley et al. | 15/314 |
| 4,202,072 | 5/1980 | Gonzales | 15/302 |
| 4,289,225 | 9/1981 | Scholta | 194/904 X |
| 4,580,309 | 4/1986 | Ogden | 15/300 |
| 4,656,687 | 4/1987 | Wei | 15/330 X |
| 4,658,464 | 4/1987 | Sharp | 15/321 |
| 4,688,292 | 8/1987 | Schmiegel | 15/300 |
| 4,805,255 | 2/1989 | Hed | 15/314 |
| 5,099,544 | 3/1992 | Yamamoto | 15/339 |
| 5,114,050 | 5/1992 | Morris | 222/192 |
| 5,239,727 | 8/1993 | Roestenberg | 15/315 |
| 5,400,464 | 3/1995 | Steiner | 15/330 |
| 5,423,407 | 6/1995 | Nikolic | 194/217 |
| 5,624,239 | 4/1997 | Osika | 417/187 |

*Primary Examiner*—F. J. Bartuska

*Attorney, Agent, or Firm*—Patent Law Offices of Rick Martin, P.C.

[57] ABSTRACT

A dual function device which provides compressed air for tire inflation and a vacuum machine for cleaning operations at a single location. The air compressor and the vacuum machine are interconnected electrically so that a user may switch back and forth between each function as rapidly as may be required by the user without overloading or stalling the air compressor. A pressure relief valve is also provided in the air compressor outlet pipe to control the air pressure in the outlet pipe, thereby allowing restarts of the air compressor in an unloaded condition. In an alternate embodiment, the air compressor is connected to an air reservior. The timer controls the operation of a solenoid or a vacuum machine. The timer energizes the solenoid, which then opens to provide compressed air from the air reservoir.

34 Claims, 7 Drawing Sheets

METHOD AND APPARATUS FOR SELECTIVE OPERATION OF AN AIR COMPRESSOR AND VACUUM MACHINE

FIELD OF INVENTION

The present invention relates to air compressor and vacuum machine systems, more particularly to systems comprising an air compressor for tire inflation and a vacuum machine for cleaning which can be operated interchangeably.

BACKGROUND OF THE INVENTION

The prior art generally comprises systems having either an air compressor for tire inflation or a vacuum machine system for cleaning. None of the prior art teaches the combination of the two components allowing easily interchangeable operation. Each system requires the user to pay a fixed price. Once the coins are deposited in the coin mechanism, the selected part of the system starts and operates for a fixed time, say five minutes. In other systems a combination of an air compressor and vacuum machine is offered, but they suffer from high start-up amperages and poor interchangeablility of operation. Other systems comprise a stand-alone coin operated air compressor or a stand-alone coin operated vacuum machine.

Representative of the art is:

U.S. Pat. No. 5,624,239 (1997) to Osika discloses a portable pneumatic vacuum source which includes a source of pressurized fluid and a vacuum pump in fluid connection with the pressurized fluid source, the vacuum pump operative to generate a vacuum in response to pressurized fluid flow therethrough.

U.S. Pat. No. 5,423,407 (1995) to Nikolic discloses a system for providing electrical power in response to deposited coins comprising a mounting post secured to the ground, an input head secured at the upper extent of the mounting post, and an output module which includes a pair of electrical receptacles adapted for the receipt of a 110 volt plug and a 220 volt plug with grounding components.

U.S. Pat. No. 5,400,464 (1995) to Steiner discloses a variable high/low vacuum/blower device which includes an interchangeable vacuum or blower device with high pressure/low air flow or low pressure/high air flow operation.

U.S. Pat. No. 5,239,727 (1993) to Roestenberg discloses a central vacuum system for workspaces such as auto body or wood shops which is rotatably mounted at a level above the heads of the shop workers and integrated with a rigid boom having a flexible vacuum hose at its distal end so that the boom may be swung in an arc parallel to the floor space and gives access to the vacuum over a wide area.

U.S. Pat. No. 5,114,050 (1992) to Morris discloses a garage forecourt installation in which the fuel dispensing pump is linked to a vacuum cleaning device so that as the fuel pump is switched on suction is made available at a suction cleaning nozzle.

U.S. Pat. No. 5,099,544 (1992) to Yamamoto discloses a vacuum cleaning apparatus with built in air pressure supply lines for operating pneumatic tools.

U.S. Pat. No. 4,805,255 (1989) to Hed discloses a coin-operated vacuum made with two housings, one for mounting the coin mechanism and the vacuum motor and blower, and the other comprising the debris collection barrel and filter.

U.S. Pat. No. 4,688,292 (1987) to Schmiegel discloses a vacuum cleaning apparatus which has a main suction hose with a dirt collecting container and an auxiliary suction box with a flexible hose which is automatically drawn into its position of non-use and is automatically cleaned during non-use.

U.S. Pat. No. 4,658,464 (1987) to Sharp discloses an apparatus for spraying a shampoo solution through a shampoo solution supply conduit to a nozzle as the nozzle is moved over an area of upholstery, carpet, and the like while dirty shampoo solution is drawn back through the nozzle to a vacuum tank by vacuum suction.

U.S. Pat. No. Des. 287,656 (1987) to Waldrep et al. discloses an ornamental design for a combined automotive air pump, vacuum cleaner, and dispensing unit for anti-freeze and air freshener.

U.S. Pat. No. 4,580,309 (1986) to Ogden discloses a compact, self-contained central vacuum cleaning machine which has expandable vacuum suction and pressure capacities and variable vacuum suction and performs a multiplicity of cleaning operations including dry vacuuming, wet vacuuming, hydro-extraction vacuuming and pressure washing.

U.S. Pat. No. 4,289,225 (1981) to Scholta discloses a coin-operated vending machine operable to compress air and dispense compressed air for a selected period to time.

U.S. Pat. No. 4,202,072 (1980) to Gonzales discloses a self-service, wet-vacuum cleaning machine for carpets, upholstery, and the like which utilized a hand-held tool attached to both a vacuum hose and a hot water horse.

U.S. Pat. No. 4,194,262 (1980) to Finley et al. discloses a vacuum extraction cleaning machine adapted for coin-operated applications.

U.S. Pat. No. 4,036,346 (1977) to Livingston discloses a coin-operated vacuum apparatus.

U.S. Pat. No. 3,910,781 (1975) to Bryant, Jr. discloses a vacuum cleaner tank which has superimposed separate top and bottom sections and is provided in its side with an air inlet for connection to a hose.

U.S. Pat. No. 3,381,327 (1968) to Kelley discloses a vacuum cleaner which is fixedly mounted and rotatable about a vertical axis and is weather conditioned for outdoor use.

None of the prior art systems provides a dual function air compressor and vacuum machine system which allows a user to rapidly switch from air compressor for tire inflation to a vacuum machine for cleaning while the system is in operation. It is necessary for a user to pay for and then operate each function separately. If the user has need of both functions, then each has to be paid for and operated separately. Prior art air compressors cannot be rapidly started and stopped at the discretion of a user in this application. This is because if the pressure in the air compressor outlet pipe or manifold is not released when the compressor is stopped, then the air compressor must be started in a "loaded" condition. This requires a substantial initial amperage in order to start the loaded motor, generally on the order of 30 amps.

What is needed is an air compressor/vacuum machine system which is started with a single payment. What is needed is an air comressor/vacuum machine system which allows a user to interchangeably select between the two modes at any time as quickly and as often as desired. What is needed is an air compressor/vacuum machine system that allows the air compressor manifold to be pressurized when the air compressor is operating and is de-pressurized when the air compressor is turned off and the vacuum machine is operating. What is needed is an air compressor motor on a dual air compressor and vacuum machine system which can be restarted with significantly reduced initial starting current.

SUMMARY OF THE INVENTION

The main aspect of the present invention is to provide an air compressor and vacuum machine system which operates with a single payment.

Another aspect of the present invention is to provide an air compressor and vacuum machine system which allows a user to rapidly switch at will between an air compressor and a vacuum machine.

Another aspect of the present invention is to provide an air compressor and vacuum machine system which allows an air compressor outlet manifold to be automatically depressurized when the air compressor is not in use.

Another aspect of the present invention is to provide an air compressor and vacuum machine system which allows an air compressor outlet manifold to be automatically pressurized when the air compressor is in use.

Another aspect of the present invention is to provide an air compressor and vacuum machine system which allows an air compressor outlet manifold to be automatically depressurized when the vacuum machine is in use.

Another aspect of the present invention is to provide an air compressor and vacuum machine system which allows an air compressor outlet manifold to be automatically pressurized when the vacuum machine is not in use.

Another aspect of the present invention is to provide an air compressor and vacuum machine system which is contained in a durable canister.

Another aspect of the present invention is to provide an air compressor and vacuum machine system having an air reservoir.

The invention comprises an air compressor and a vacuum machine contained in a single housing. Either the air compressor or the vacuum machine is started by a user depositing payment. The user selects the desired function by use of a switch that selects between the air compressor or the vacuum machine. Once the payment is made, a timer energizes and times the operation of the selected function. While the air compressor is energized, a pressure reducing valve is closed which maintains the pressure in the outlet pipe of the air compressor, allowing air to flow to an air hose. If the user then selects the vacuum machine for operation, the vacuum machine is turned on, the air compressor is turned off and the pressure reducing valve is de-energized, whereby the pressure in the outlet pipe is released to the atmosphere. Therefore, the air compressor will always be started in an unloaded condition. Consequently, a user may switch back and forth between the air compressor and the vacuum machine at will with a single payment. In an alternate embodiment, an air reservoir is connected to the air compressor so that an amount of compressed air may be stored for use as needed. A solenoid valve then allows air to flow from the reservoir to a hose upon deposit of payment by a user.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
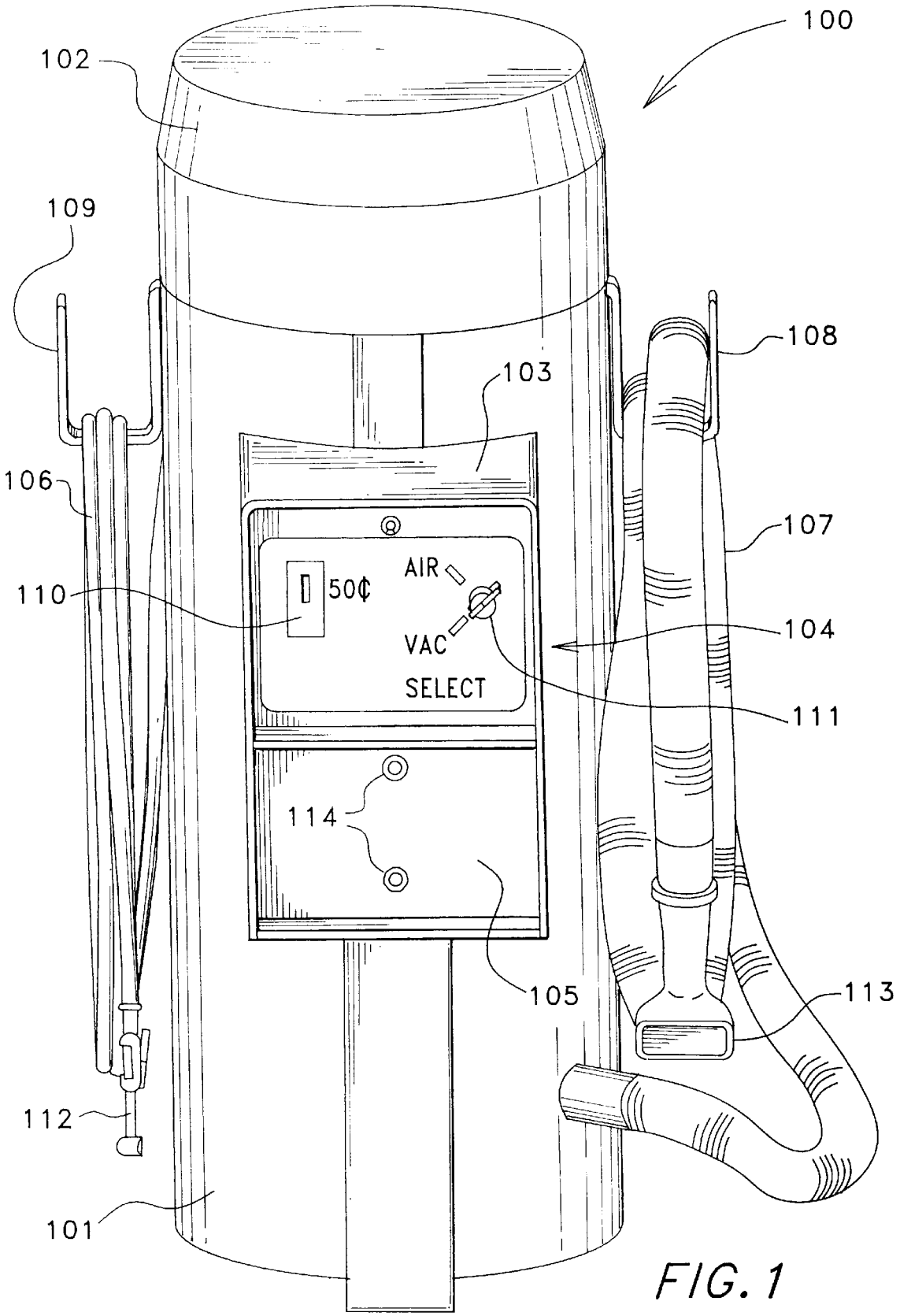
FIG. 1 is a front plan view of the preferred embodiment.

Referring first to FIG. 1 the system 100 comprises canister 101 and cover 102. Cover 102 may be connected to canister 101 by various means including screws, pins and bolts (not shown) or by any appropriate method known in the art. Canister 101 may be constructed of any durable material such as stainless steel, aluminum, fiberglass or PVC. Canister 101 in the preferred embodiment is tubular, however, any shape such as rectangular or square will also suffice. Attached to the outside of canister 101 is cabinet 103. Cabinet 103 houses the electrical components, described later in this specification. Control panel 104 is removeably mounted to cabinet 103 to allow easy access to the interior of the cabinet 103 for maintenance purposes. A coin mechanism slot 110 receives the payment from a user. Payment for the desired service is made by a user in coin. Rotary switch 111 is set by a user to the desired function, either air compression for tire inflation or the vacuum machine for vehicle cleaning. Rotary switch 111 may also comprise a single throw switch or a double throw switch. Any other switch designed to operate two pieces of equipment serially, known in the art, would also be acceptable. It is not necessary for a user to select a function prior to deposit the coin(s) to initiate operation simply because if the function not originally selected is desired, the rotary switch 111 may be moved to that function at any time with any frequency as may be desired by a user. Below control panel 104 is the coin box 105. The arrangement of the coin mechanism slot 110 and coin box 105 is well known in the art. Coin box 105 is locked closed with locks 114. Equivalent to a coin mechanism is a credit card device, card reader, currency mechanism or any other vend type money receiver system or money transfer system.

Figure 8:
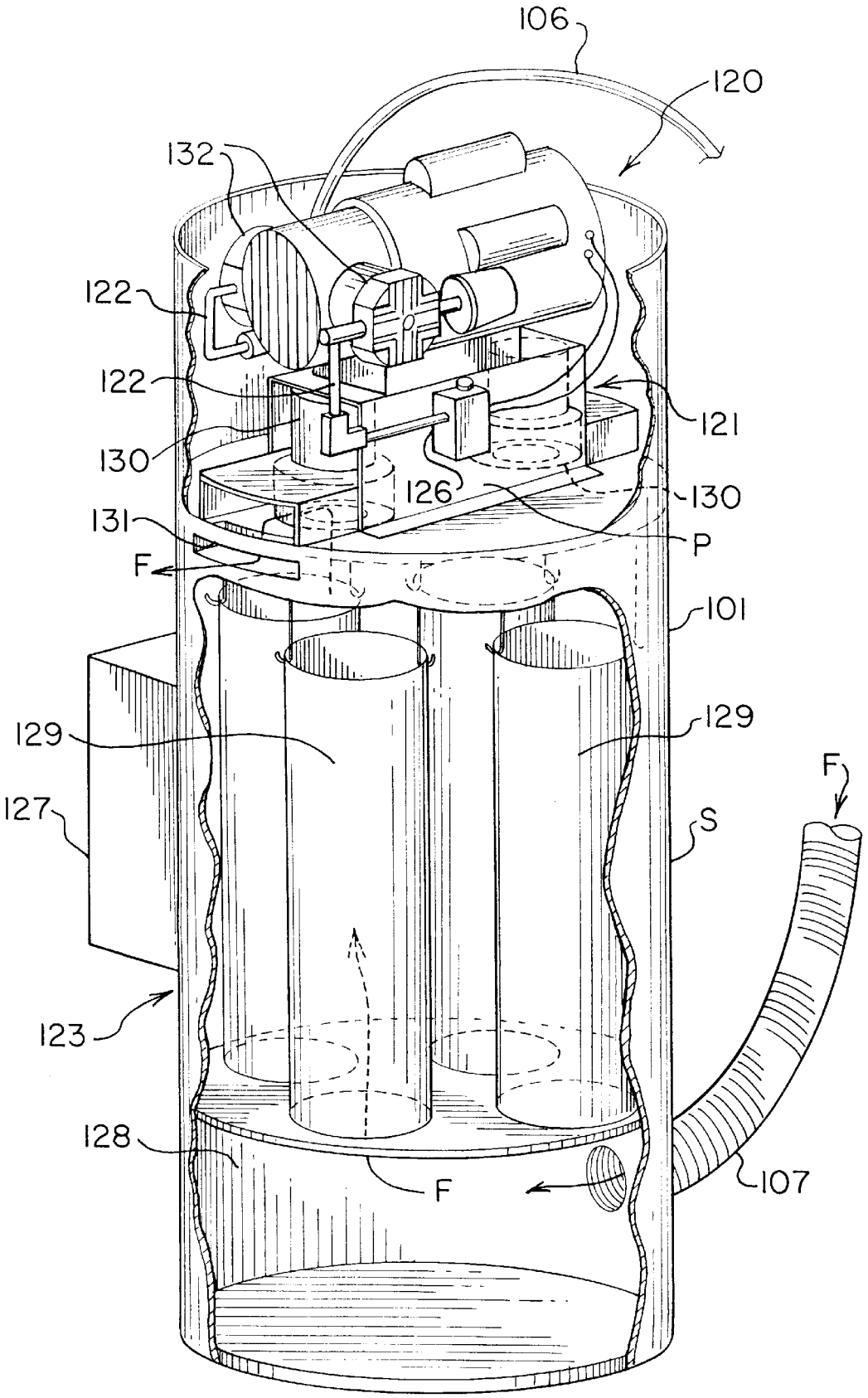
FIG. 8 is a cutaway view of FIG. 1 depicting the internal arrangement of components in the invention.

Reference is made to FIG. 8, which depicts the general arrangement of components in the invention. Contained within canister 101 is air compressor 120 and vacuum machine 121. The arrangement shown is the preferrred embodiment, however, any arrangement which allows containment of the air compressor and the vacuum machine in the same canister, or housing, will suffice. Air compressor 120 may be a close-coupled compressor or other known in the art. It may have one, two or more compression heads 132. The outlet pipe or manifold 122 extends from the heads 132 through the exterior surface of the canister 101. A compressed air hose 106 is attached to the end of the outlet pipe or manifold 122. The vacuum machine 121 is known in the art. In the preferred embodiment it comprises blowers 130 installed with a plenum P. However, a single blower arrangement will also suffice. During operation of the vacuum machine 121, air flow F is routed through the vacuum hose 107 into the compartment 128 through filter 129 into blowers 130 and exhausted through slot 131. Flexible hose 107 is attached to the exterior surface S of the canister 101. Cabinet 127 is described in FIG. 1. Pressure reducing valve 126 is shown in FIG. 1 connected to outlet pipe 122. An unloader valve (not shown, described in FIG. 4) may also be installed in the outlet pipe 122. Contained within canister 101 is the debris collection area or compartment 128. Filters 129, known in the art, remove debris from the exhaust air. The filters 129 and compartment 128 are accessed for cleaning by through access doors known in the art(not shown).

Figure 2:
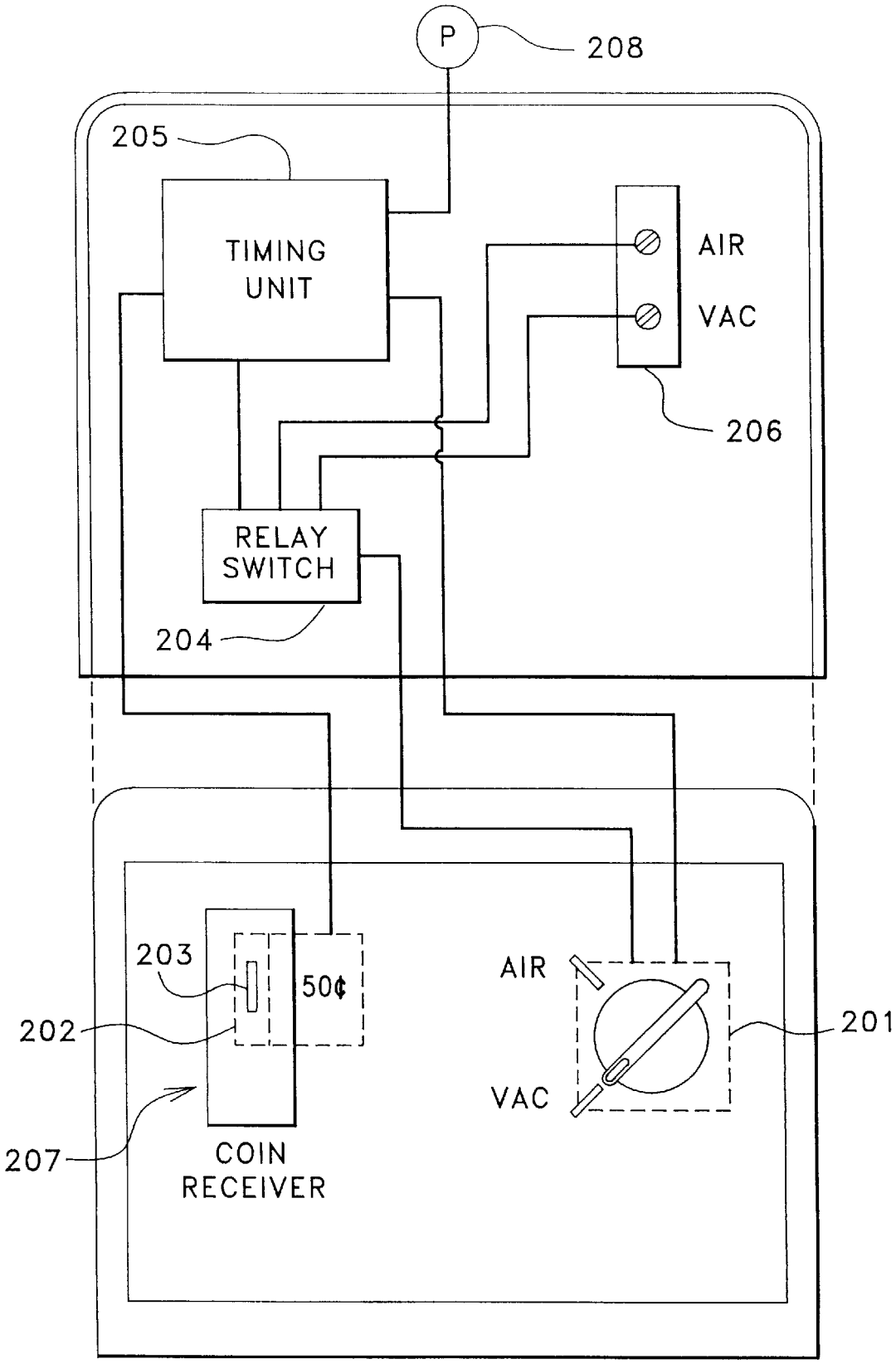
FIG. 2 is a schematic diagram of the system controls.

FIG. 2 is a schematic diagram of the system electrical control. Rotary switch 201 is connected to relay switch 204 and to timing unit 205. Timing unit 205 is connected to coin mechanism 202, to the relay 204 and to the power source 208. In operation, a user inserts a predetermined number of coins into coin mechanism slot 203. Coin mechanism 202 is well known in the art. Insertion of the required number of coins causes coin mechanism 202 to send a signal to timing unit 205. Timing unit 205 then energizes the selected circuit, either to the air compressor or the vacuum machine. The timing unit sends a signal to the rotary switch 201 and then to the relay 204 which starts operation of the air compressor or vacuum machine. Relay 204 is connected to the system component at terminal strip 206. The timing unit 205 is well known in the art and may be set by an owner/operator to operate the component chosen for a predetermined length of time. Once the preset amount of time has elapsed, timing unit 205 de-energizes the selected function.

Figure 3:
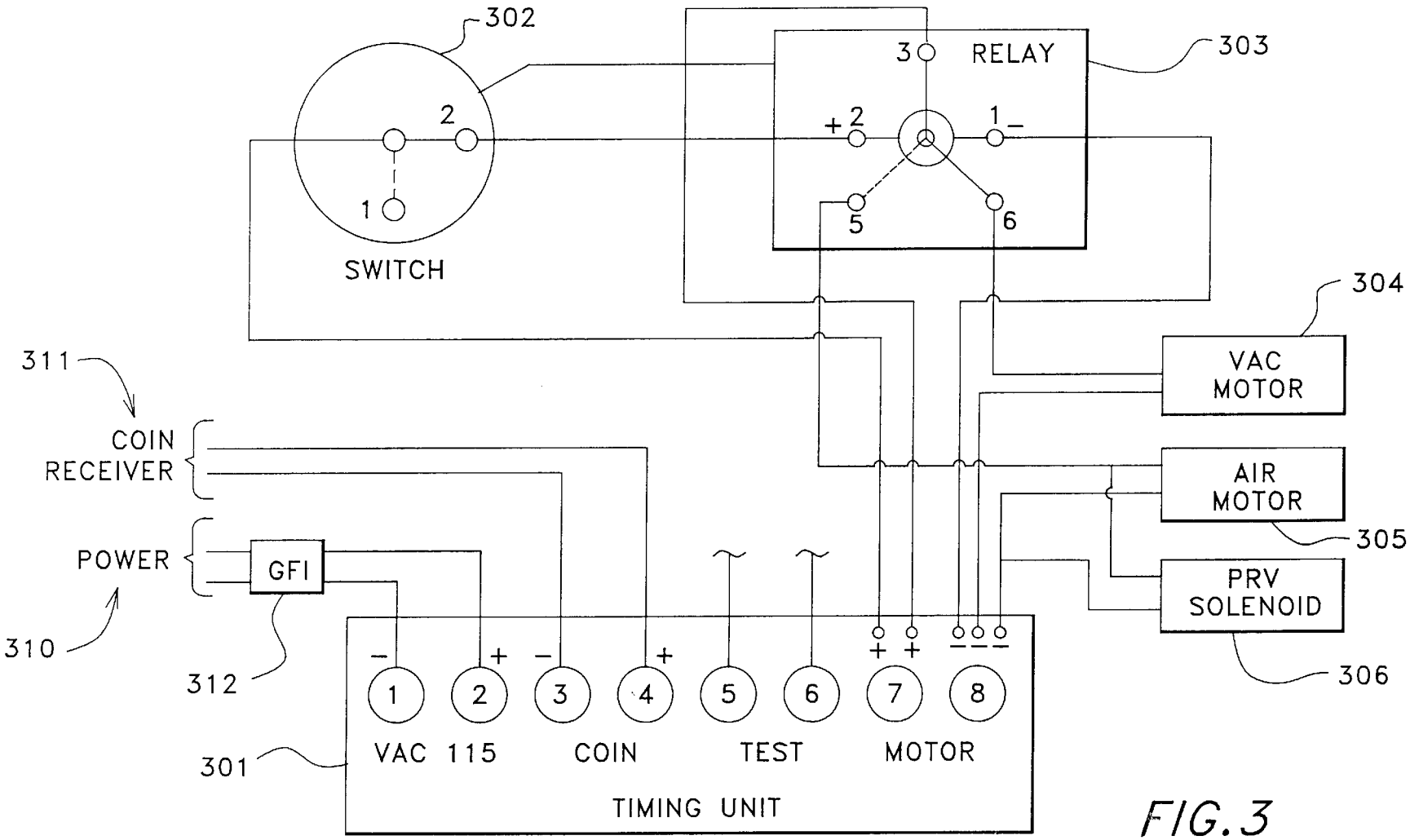
FIG. 3 is an electrical schematic depicting the wiring for the components.

FIG. 3 is an electrical schematic depicting the wiring of the components. Timing Unit 301 comprises a number of connections. Power 310 is connected at 1-2. The coin mechanism 311 is connected at 3-4. Test connections are at 5-6. The air compressor motor 305 and vacuum motor 304 are connected at 7-8. These connection numerals on the timing unit are for ease of reference only, and any appropriate termination arrangement known in the art will suffice. Rotary switch 302 is used to select either the air compressor or vacuum machine. As shown, position "2" of rotary switch 302 operates the vacuum machine motor 304. Position "1" of rotary switch 302 causes the air compressor motor 305 to operate. Operation of each is caused by operation of relay 303 as controlled by rotary switch 302. Position "6" of relay 303 causes the vacuum motor to operate. Position "5" of the relay causes the air compressor motor to operate. The relay numerals are for ease of reference only, and any appropriate switch arrangement known in the art will suffice.

Figure 4:
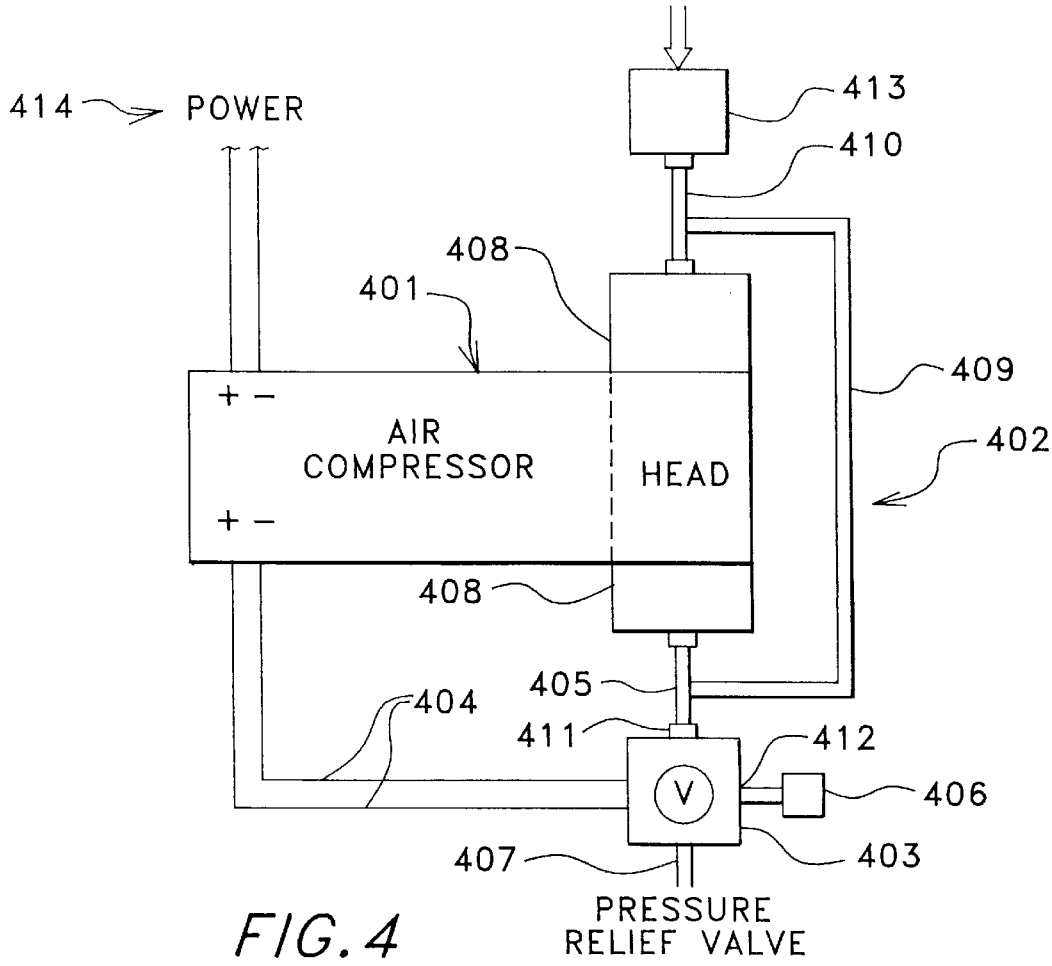
FIG. 4 is a schematic of the piping on the air compressor.

Pressure reducing valve 306 is electrically connected to the electrical leads for the air compressor motor 305 such that the valve 306 is energized when the air compressor motor 305 is energized. When air compressor motor 305 is de-energized, pressure reducing valve 306 is also de-energized. Pressure reducing valve 306 comprises a two-way valve. The inlet port is connected to the outlet pipe or manifold of an air compressor (not shown). The manifold is pressurized during operation of the air compressor. Valve 306 is also energized during this time. This causes the valve 306 to be in a first position. In this first position, a path for air flow is open to ambient atmoshere. Since this is undesirable, a plug is inserted or threaded into the port, as shown in FIG. 4. When the air compressor is de-energized, such as when operation of the vacuum machine is selected, the valve 306 moves to a second position. In the second position, a second port is opened to ambient, and the pressure contained within the air compressor and manifold is released to the atmosphere. Although the preferred embodiment discloses the foregoing two-way valve, any single or multiple port valve, known in the art, will also suffice to allow the air pressure in the outlet pipe to be released when the air compressor is de-energized. The ground fault interrupter 312 is known in the art and described in FIG. 7.

FIG. 4 is a schematic of the piping on the air compressor. Power 414, which may be any available commercial voltage including 120 V, is connected to the air compressor motor. Air compressor 401 comprises heads 408. Heads 408 are connected by manifold or pipe 409. The preferred embodiment utilizes a two head air compressor. A single or mutlitple head compressor may also be used. Connected to manifold 409 by pipe 405 is pressure relief valve 403 at connection 411. Pressure relief valve 403 is electrically connected to the air compressor motor by leads 404 as described in FIG. 3. The first port 412 corresponds to the first position of the valve as described in FIGS. 3 and 5. Second port 407 corresponds to the second position of the valve as described in FIG. 3. Plug 406 is inserted into first port 412. Second port 407 is left open to the atmosphere. Valve 403 operates as described in FIG. 3. The pressurized air from manifold 409 is connected to air hose (now shown) by pipe 410. Also connected in the pipe is unloader valve 413. In operation, if the volumetric flow rate of air from head 402 is reduced to less than the range of 80% to 90% of a full air flow condition, the unloader valve will open to reduce backpressure on air compressor head 402. This may occur when the air hose is not in use for filling a tire, but the air compressor is selected and in operation. This reduces the load on the air compressor motor.

Figure 5A:
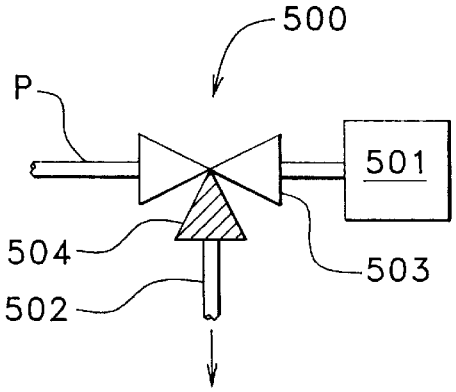
FIG. 5*a* is a diagram of the pressure relief valve in the closed operating mode.
Figure 5B:
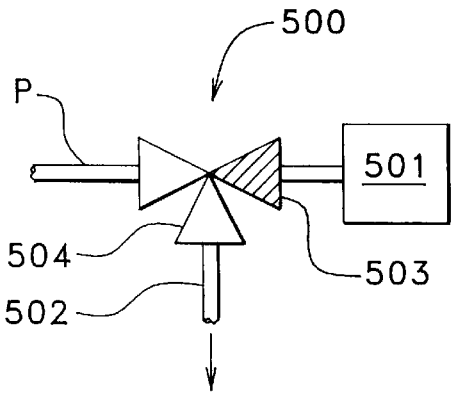
FIG. 5*b* is a diagram of the pressure relief valve in the open operating mode.

FIG. 5 is a schematic of pressure relief valve 500 in the energized position (A) and de-energized position (B). Plug 501 is inserted into a first outlet port 503 on the pressure relief valve 500. The pressure relief valve is connected to the air compressor outlet manifold by pipe P. When the air compressor is energized, pressure relief valve is also energized in position (A), resulting in second outlet port 504 being closed. When the air compressor is de-energized, pressure relief valve 500 is also deenergized, and first outlet port 503 is closed, and second outlet port 504 is open. This allows the air pressure in the air compressor outlet manifold to be released to ambient when the air compressor is not operating. This results in the air compressor being "unloaded" when not in operation, thereby allowing quick and numerous unloaded restarts at the discretion of a user.

Figure 6:
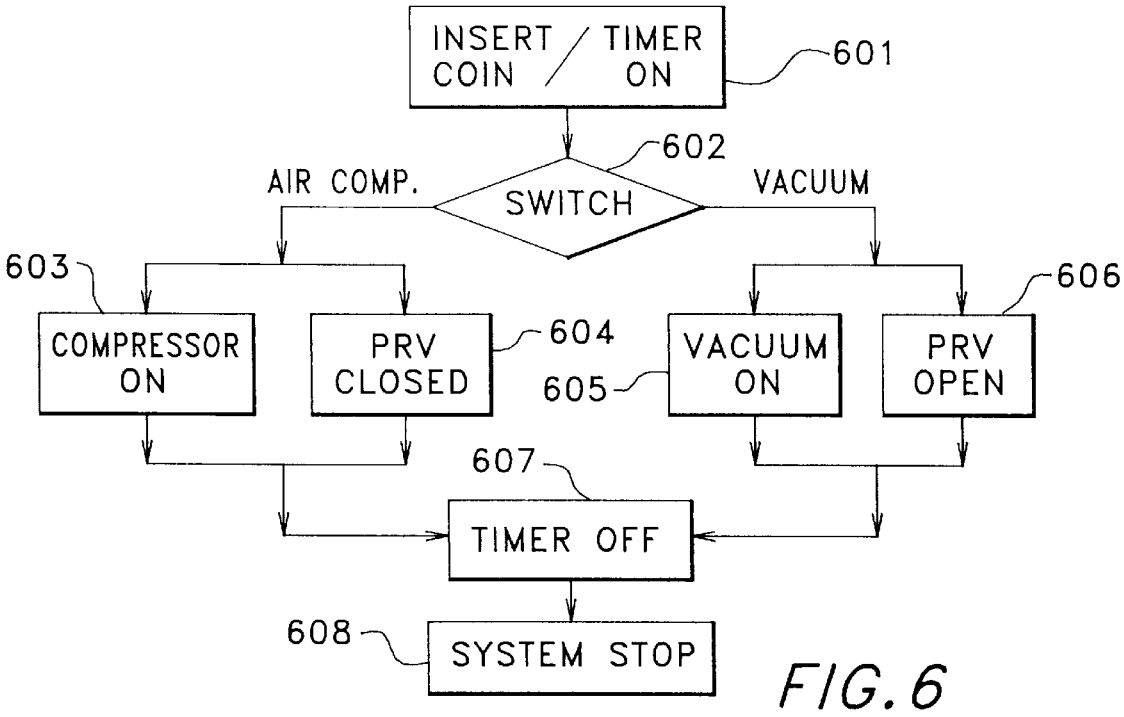
FIG. 6 is a flow diagram of the control logic.

FIG. 6 is a flow diagram of the control logic. At step 601 a user inserts a coin into the coin mechanism. A signal is sent by the coin mechanism to the timer which closes the power circuit. The switch is set to either the air compressor setting or the vacuum machine setting by a user at step 602. If the air compressor setting is chosen, the air compressor starts, step 603. The pressure reducing valve (PRV) is simultaneously closed when the air compressor motor circuit is energized, step 604. If the vacuum machine setting is chosen on the switch, then vacuum machine starts, step 605. The pressure reducing valve is simultaneously opened when the air compressor circuit is de-energized, step 606. The PRV is wired in parallel with the air compressor motor so that it is energized or de-energized along with the air compressor motor. See FIG. 3. The chosen function then operates until the timer "times-out" and then de-energizes the particular circuit, step 607 and 608. The system then is ready for the next user.

Figure 7:
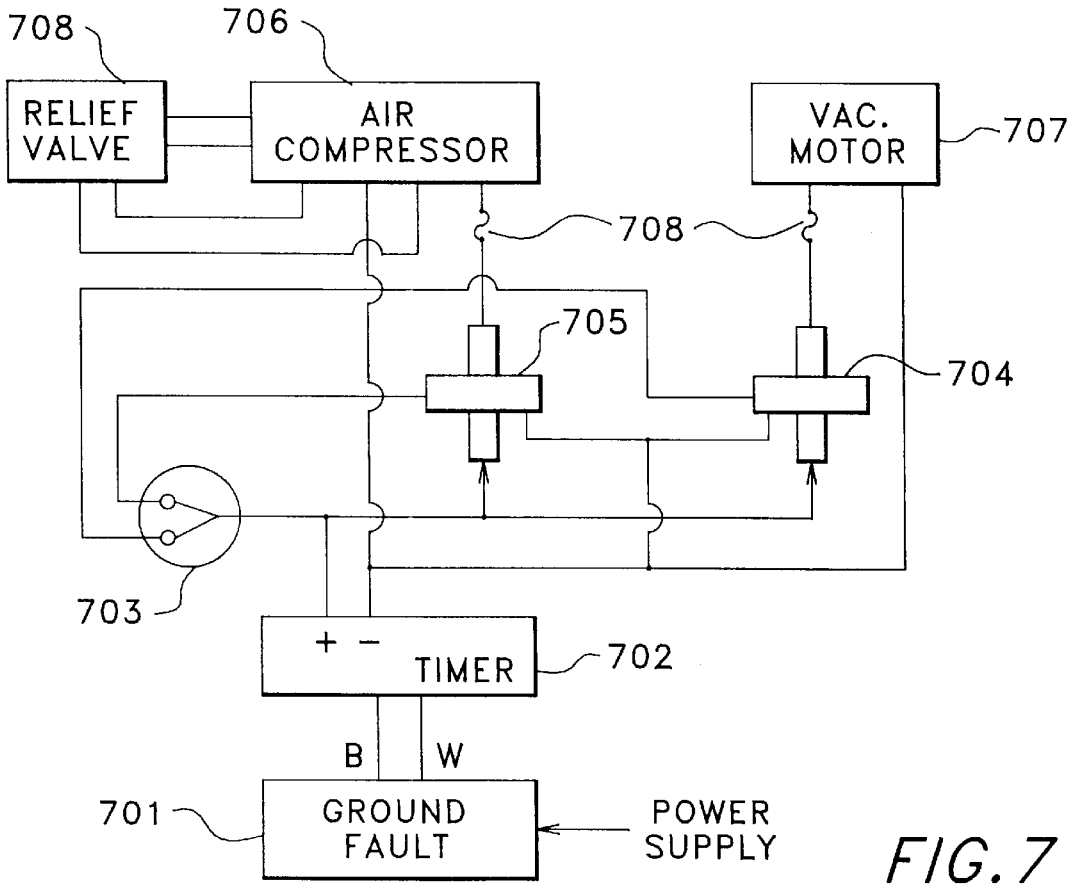
FIG. 7 is a schematic of an alternate embodiment depicting mercury relay switches.

FIG. 7 is a schematic of an alternate embodiment depicting mercury relay switches. The circuit is the same as disclosed in FIG. 3 with the exception that in lieu of the mechanical type relay shown in FIG. 3, in this alternate embodiment two mercury switch relay's are used. Switch 705 is connected to the air compressor 706. Switch 704 is connected to vacuum machine motor 707. Fuses 708 are also included in each circuit. Also depicted is a ground fault interrupter (GFI) 701 in the power circuit, which is known in the art.

Figure 9:
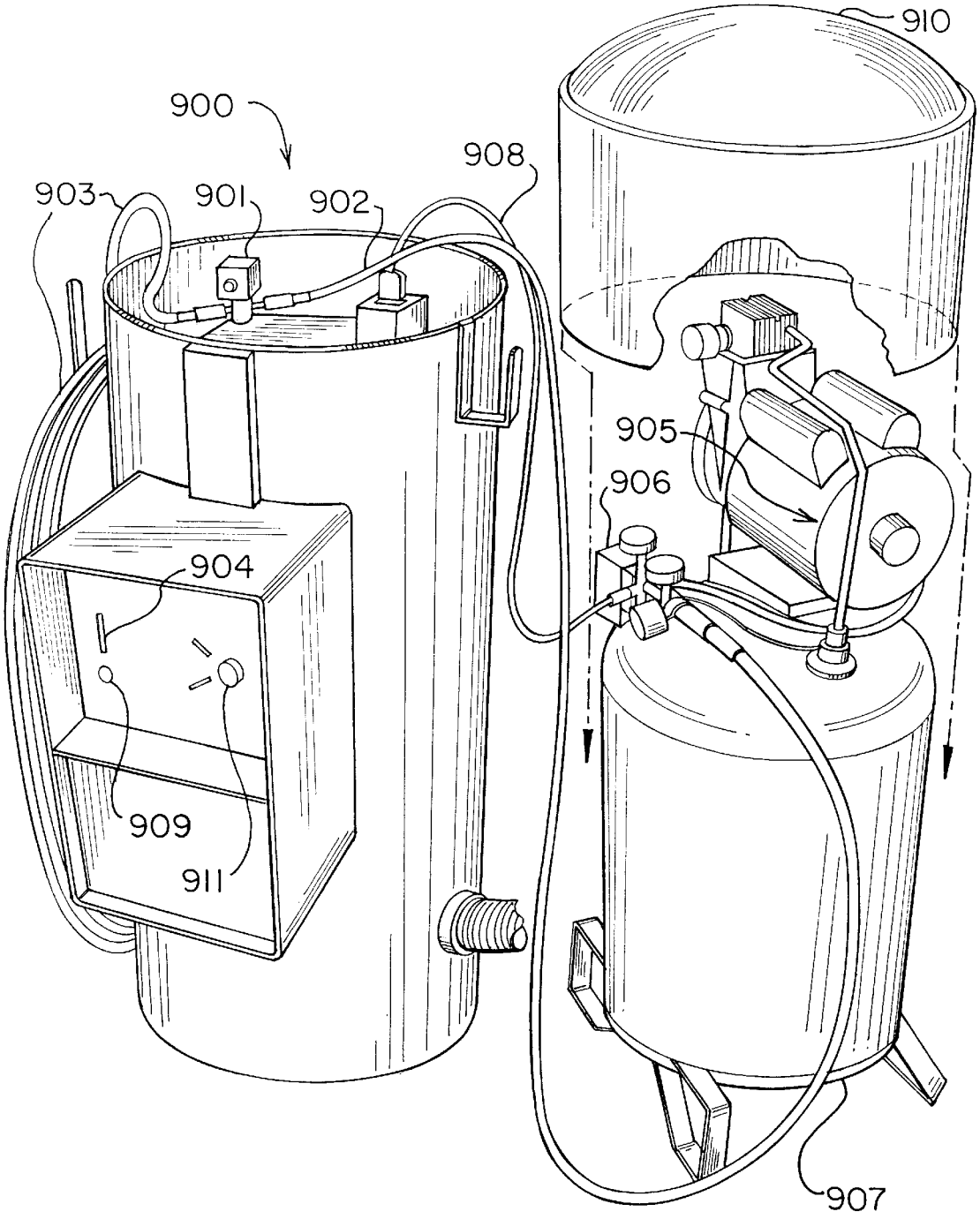
FIG. 9 is a general arrangement view of an alternate embodiment.

FIG. 9 is a general arrangement view of an alternate embodiment of the invention. The canister containing the vacuum machine is shown as 900. The internal arrangement of the canister, but for the air compressor, is as described above, including FIG. 8. In this alternate embodiment, air compressor 905 is mounted remote from the canister 900. Air compressor 905 is electrically connected to pressure switch 906, which is well known in the art. Pressure switch 906 is set to a desired pressure and pneumatically senses the pressure in air reservior 907. When the pressure in air reservoir 907 falls below a desired value, for example 120PSI, pressure switch 906 energizes air compressor 905 thereby repressurizing the air reservoir. Once air reservoir 907 is repressurized to a desired pressure, pressure switch 906 de-energizes the air compressor. This also pressurizes air hose 902 up to solenoid 901. Air hose 902 is connected to air reservior 907. Solenoid 901 is installed in air hose 902. Solenoid 901 is normally closed. When a user inserts payment in slot 904 the timer (described above in specification pertaining to FIGS. 2 and 3) energizes solenoid 901 which causes air hose 903 to be pressurized for use. The wiring and operation of the timer in this alternate embodiment is as described in the prior figures, with the exception that in this alternate embodiment the timer through switch 911 controls the duration of operation of the soleniod 901 (for providing compressed air from the air reservior 907) and the vacuum machine (for providing vacuum). The timer does not directly control the operation of the air compressor 905 through switch 911. Payment also causes indicator light 909 to illuminate thereby showing a user that the system is energized and ready for use. Indicator light 909 may be any color, including green. Since air reservior 907 may be fully charged when a user makes payment, air compressor 905 may not start at the time of payment. However, without the sound of the air compressor 905 in operation, a user may not know the system is ready for use. Hence, the indicator light 909. Since pressure switch 906 only senses the pressure in the air reservior, pressurization of air reservior 907 occurs independent of the operation of soleniod 901. Switch 911 performs that same function as described in prior figures, allowing a user to switch back and forth between the vacuum machine (not shown) and the air compressor. Further, air compressor 905 may be electrically connected to the canister electrical system or to another convenient electrical outlet by wire 908. Cover 910 is removeably installed over air compressor 905 to protect it from the elements.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A device for providing compressed air and vacuum comprising:

an air compressor having an outlet pipe;

a vacuum machine;

a money receiver which sends a signal to energize a circuit upon deposit of payment;

a switch connected to said air compressor and to said vacuum machine for selecting for operation the air compressor and the vacuum machine in any sequence;

a timer connected to said switch and to said money receiver whereby said signal to energize a circuit is received by said timer, and whereby said timer then energizes and controls a duration of operation of the air compressor and the vacuum machine; and a pressure relief valve attached to said outlet pipe whereby a pressure in said outlet pipe is controlled.

2. The device for providing compressed air and vacuum as set forth in claim 1, wherein said pressure relief valve is in a first position when said air compressor is energized, thereby containing pressure within said outlet pipe.

3. The device for providing compressed air and vacuum as set forth in claim 2, wherein said pressure relief valve is in a second position when said air compressor is de-energized, thereby releasing pressure from said outlet pipe.

4. The device for providing compressed air and vacuum as set forth in claim 3, wherein said pressure relief valve further comprises:

a first outlet port and a second outlet port;

said first outlet port having a plug; and said second outlet port open to atmosphere.

5. The device for providing compressed air and vacuum as set forth in claim 4, wherein said switch comprises a rotary switch.

6. The device for providing compressed air and vacuum as set forth in claim 5, further comprising a canister having:

a removeable cover fastened to a top of said canister with fastening means, said canister housing the air compressor and the vacuum machine.

7. The device for providing compressed air and vacuum as set forth in claim 6 further comprising a compressed air hose connected to said outlet pipe and projecting from an exterior surface of said canister.

8. The device for providing compressed air and vacuum as set forth in claim 7 further comprising a vacuum hose connected to said vacuum machine and projecting from an exterior surface of said canister.

9. The device for providing compressed air and vacuum as set forth in claim 7, wherein said compressed air hose further comprises a tire inflator connector connected to an end of said compressed air hose.

10. The device for providing compressed air and vacuum as set forth in claim 9, wherein said switch comprises a dual pole switch.

11. The device for providing compressed air and vacuum as set forth in claim 9, wherein said canister comprises metal.

12. The device for providing compressed air and vacuum as set forth in claim 1, wherein said money receiver further comprises a coin mechanism having a coin box.

13. The device for providing compressed air and vacuum as set forth in claim 12 further comprising:

a mechanical relay connected to said timer and to said switch; and said mechanical relay connected to said vacuum machine and to said air compressor.

14. The device for providing compressed air and vacuum as set forth in claim 12 further comprising:

a first and second mercury switch relay connected in series with said timer and to said switch;

said first mercury switch relay also connected to said air compressor; and said second mercury switch also connected to said vacuum machine.

15. The device for providing compressed air and vacuum as set forth in claim 6, further comprising an unloader valve installed in said outlet pipe for relieving pressure in said outlet pipe.

16. A method for providing compressed air and vacuum comprising the steps of:

fabricating a canister;

installing an air compressor having an outlet pipe in said canister;

installing a vacuum machine in said canister;

installing a money receiver in said canister;

connecting a timer to said money receiver;

connecting a switch to said timer and to said air compressor and to said vacuum machine;

selecting for operation the air compressor or the vacuum machine with said switch;

sending a signal from said money receiver to said timer upon deposit of payment;

energizing the air compressor or the vacuum machine with said timer;

timing the duration of energization of the air compressor or the vacuum machine; and controlling the pressure in said outlet pipe with a pressure relief valve attached to said outlet pipe.

17. The method for providing compressed air and vacuum as set forth in claim 16 further comprising the step of:

setting said pressure relief valve to contain pressure within said outlet pipe when said air compressor is energized.

18. The method for providing compressed air and vacuum as set forth in claim 17 further comprising the step of:

setting said pressure relief valve to release pressure from said outlet pipe when said air compressor is de-energized.

19. The method for providing compressed air and vacuum as set forth in claim 18 further comprising the step of:

using a pressure relief valve having a first outlet port and a second outlet port;

installing a plug in said first outlet port; and opening said second outlet port to atmosphere.

20. The method for providing compressed air and vacuum as set forth in claim 18 further comprising the step of:

installing an unloader valve in the outlet pipe.

21. A device for providing compressed air and vacuum comprising:

an air compressor having an outlet pipe;

a vacuum machine;

a money receiver which sends a signal to energize a circuit upon deposit of payment;

a switch connected to said air compressor and to said vacuum machine for selecting for operation the air compressor and the vacuum machine in any sequence; and a timer connected to said switch and to said money receiver whereby said signal to energize a circuit is received by said timer, and whereby said timer then energizes and controls the duration of operation of the air compressor or the vacuum machine.

22. A method for providing compressed air and vacuum comprising the steps of:

fabricating a canister;

installing an air compressor having an outlet pipe in said canister;

installing a vacuum machine in said canister;

installing a money receiver in said canister;

connecting a timer to said money receiver;

connecting a switch to said timer and to said air compressor and to said vacuum machine;

selecting for operation the air compressor or the vacuum machine with said switch;

sending a signal from said money receiver to said timer upon deposit of payment;

energizing the air compressor or the vacuum machine with said timer; and timing the duration of energization of the air compressor or the vacuum machine.

23. A device for providing compresses air and vacuum comprising:

an air compressor connected to an air reservoir;

a vacuum machine;

a solenoid connected to said air reservoir;

a money receiver which sends a signal to energize a circuit upon deposit of payment;

a switch connected to said soleniod and to said vacuum machine for selecting for operation the solenoid and the vacuum machine in any sequence;

a timer connected to said switch and to said money receiver whereby said signal to energize a circuit is received by said timer, and whereby said timer then energizes and controls the duration of operation of the solenoid or the vacuum machine.

24. The device for providing compressed air and vacuum as claimed in claim 23 further comprises:

a pressure switch for sensing a pressure in said air reservoir connected to said air compressor and said air reservoir whereby the air compressor may be started and stopped upon operation of said pressure switch.

25. The device for providing compressed air and vacuum as set forth in claim 24, wherein said switch comprises a rotary switch.

26. The device for providing compressed air and vacuum as set forth in claim 25, further comprising a canister having:

a removeable cover fastened to a top of said canister with fastening means, said canister housing the vacuum machine.

27. The device for providing compressed air and vacuum as set forth in claim 26 further comprising a compressed air hose connected to said solenoid and projecting from an exterior surface of said canister.

28. The device for providing compressed air and vacuum as set forth in claim 27 further comprising a vacuum hose connected to said vacuum machine and projecting from an exterior surface of said canister.

29. The device for providing compressed air and vacuum as set forth in claim 27, wherein said compressed air hose further comprises a tire inflator connector connected to an end of said compressed air hose.

30. The device for providing compressed air and vacuum as set forth in claim 24, wherein said switch comprises a dual pole switch.

31. The device for providing compressed air and vacuum as set forth in claim 28, wherein said canister comprises metal.

32. The device for providing compressed air and vacuum as set forth in claim 23, wherein said money receiver further comprises a coin mechanism having a coin box.

33. The device for providing compressed air and vacuum as set forth in claim 32 further comprising:

a mechanical relay connected to said timer and to said switch; and said mechanical relay connected to said vacuum machine and to said solenoid.

34. The device for providing compressed air and vacuum as set forth in claim 32 further comprising:

a first and second mercury switch relay connected in series with said timer and to said switch;

said first mercury switch relay also connected to said solenoid; and said second mercury switch also connected to said vacuum machine.

* * * * *